United States Patent [19]

Kubiatowicz

[11] 4,416,083

[45] Nov. 22, 1983

[54] MOLDABLE TOY VEHICLE

[75] Inventor: James F. Kubiatowicz, Fridley, Minn.

[73] Assignee: Custom Concepts, Incorporated, Minneapolis, Minn.

[21] Appl. No.: 396,153

[22] Filed: Jul. 8, 1982

Related U.S. Application Data

[63] Continuation of Ser. No. 212,546, Dec. 3, 1980, abandoned.

[51] Int. Cl.[3] ..... A63H 17/00

[52] U.S. Cl. ..... 46/208; 46/206

[58] Field of Search ..... 46/206, 208, 209, 201, 46/223

[56] References Cited

U.S. PATENT DOCUMENTS

| | | | |
|---|---|---|---|
| 1,563,293 | 11/1925 | Santangelo | 46/204 |
| 1,853,833 | 4/1932 | Peake | 46/223 |
| 2,749,660 | 6/1956 | Zimentstark | 46/223 |
| 3,224,135 | 12/1965 | Wright et al. | 46/223 X |
| 3,643,375 | 2/1972 | Ginsberg et al. | 46/208 |
| 3,668,804 | 6/1972 | Winston | 46/201 X |
| 3,769,746 | 11/1973 | Prodger et al. | 46/208 X |

FOREIGN PATENT DOCUMENTS

| | | | |
|---|---|---|---|
| 136708 | 1/1948 | Australia | 46/201 |
| 247806 | 6/1912 | Fed. Rep. of Germany | 46/206 |
| 791118 | 12/1935 | France | 46/208 |

*Primary Examiner*—Mickey Yu

*Attorney, Agent, or Firm*—William L. Huebsch

[57] ABSTRACT

A toy vehicle having a driven member including an axle rotatably mounted on a vehicle body to which axle are fixed two wheels and an intermediate star gear; and a drive member having a drive shaft transverse of the axle which may be rotated via a crank at one end to wind a rubber band attached between the other end of the drive shaft and the body so that energy stored in the rubber band will drive the star gear on the axle via a star gear on the drive shaft.

5 Claims, 11 Drawing Figures

MOLDABLE TOY VEHICLE

This is a continuation of application Ser. No. 212,546, filed Dec. 3, 1980, now abandoned.

BACKGROUND OF THE INVENTION

This invention relates to inexpensive toy vehicles that can be molded of polymeric material, and, in one aspect, to such vehicles which are powered by a manually-wound rubber band.

Heretofore, inexpensive toy vehicles which could be molded of polymeric material and provided as premium items in cereal boxes and the like have not been as effective as playthings as has been desired. One type of such toy vehicles comprised a flywheel and included means by which the flywheel could be caused to rotate, after which the vehicle was positioned with the flywheel in contact with a generally level surface and the energy stored in the flywheel would propel the vehicle across the surface.

In one such vehicle the means for causing the flywheel to rotate was a fan blade formed around its hub, and to cause the flywheel to rotate a child blew through its hub. That vehicle, however, required substantial wind energy to bring the flywheel to high r.p.m., and the energy stored in the flywheel was quickly dissipated without propelling the vehicle for a substantial distance.

In another such vehicle the means for causing the flywheel to rotate included a spur gear at its hub. A user pulled a rack over the spur gear to cause the flywheel to rotate at high r.p.m. As with the wind-operated flywheel, however, the energy was too quickly dissipated without driving the vehicle for a substantial distance.

Another type of such toy vehicles had a drive wheel driven directly by a twisted rubber band supporting the drive wheel at its hub. That type of vehicle required an inordinate rotation of the drive wheel to wind the rubber band, however, and thus was not as much fun to use as might otherwise be the case.

BRIEF DESCRIPTION OF THE INVENTION

The present invention provides a toy vehicle, the parts for one embodiment of which can be molded of a polymeric material and used as molded as premium items in cereal boxes and the like, which vehicle is easier to activate and/or runs for greater distances than the prior art vehicles described above, and thus provides more enjoyment for the user.

According to the present invention there is provided a toy vehicle adapted to be driven by a rubber band. The toy vehicle comprises (1) a unitary driven assembly or member comprising an axle, two wheels coaxially fixed on the axle, and a star gear coaxially fixed on the axle between the wheels having a plurality of radially projecting teeth; (2) a unitary drive assembly or member comprising a drive shaft, means at a first end of the drive shaft adapted to be manually engaged to rotate the drive shaft about its axis, a hook fixed at an opposite second end of the drive shaft adapted to receive a length of the rubber band, and a star gear coaxially fixed on the drive shaft between its ends having a plurality of radially projecting teeth; and (3) a unitary body including rubber band engagement means adapted for engaging a portion of a rubber band, means for receiving and rotatably supporting the drive member with its hook spaced from the rubber band engagement means to support a rubber band therebetween in general alignment with the axis of the drive shaft, and means for receiving and rotatably retaining the driven member with the axis of the axle transverse of the axis of the drive shaft and teeth on the star gears in right-angle engagement to transfer driving force from the rubber band when it is wound to the wheels so that the vehicle will be propelled.

The use of 4 to 6 teeth on the star gears both allows the drive and driven members to be individually molded (which could not easily be done with a single-action injection mold if more than 6 teeth were formed) while still allowing those members to transmit power with reasonable smoothness between the edge surfaces of the teeth (which does not occur if less than 4 teeth are used). The use of 4 tapered teeth having edge surfaces on each tooth in a plane normal to the axis of the star gear, which edge surfaces are disposed in the range between about 10 to 30 degrees (preferably 15 degrees) relative to each other, is preferred as providing the best combination of easy moldability and acceptably smooth right-angle power transfer; and the use of such tapered teeth which are conical with spherical tips has been found to provide the most smoothness for power transfer between such members.

Also, in one embodiment particularly adapted for the toy market the vehicle may include a simple manually-releasable means for stopping operation of the vehicle after the rubber band for powering the vehicle has been wound.

BRIEF DESCRIPTION OF THE DRAWING

The present invention will be more thoroughly described with reference to the accompanying drawing in which like numbers refer to like parts in the several views and wherein.

DESCRIPTION OF THE PREFERRED EMBODIMENT

Figure 1:
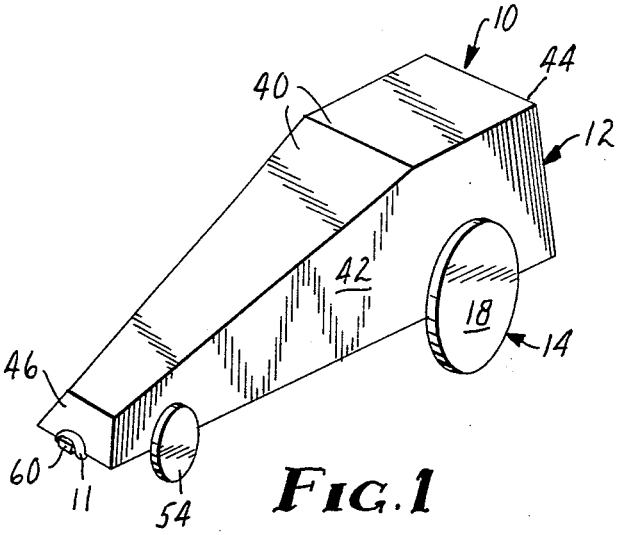
FIG. 1 is a perspective view of a first embodiment of a moldable toy vehicle according to the present invention.
Figure 2:
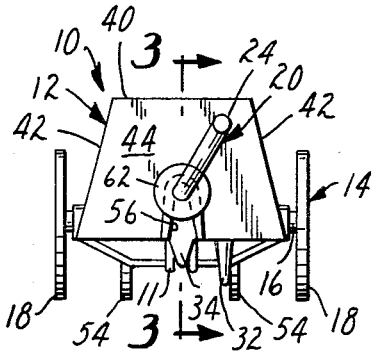
FIG. 2 is a rear end view of the toy vehicle of FIG. 1.
Figure 3:
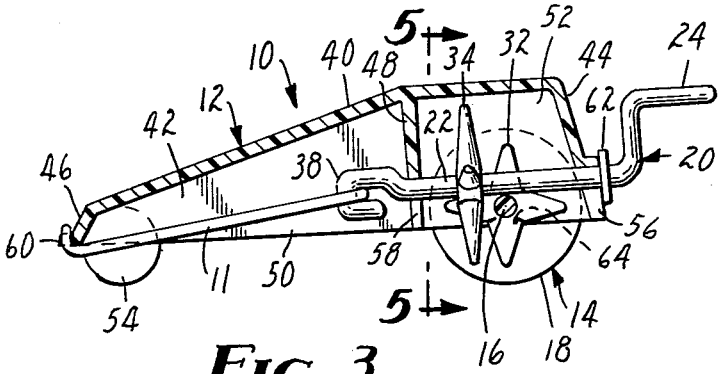
FIG. 3 is a sectional view taken approximately along line 3—3 of FIG. 2.
Figure 4:
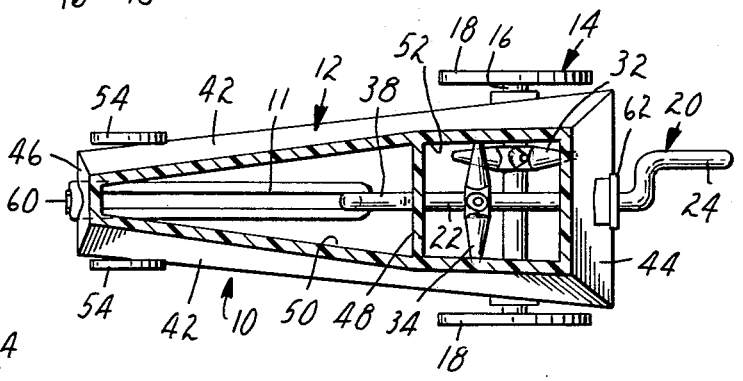
FIG. 4 is a top view of the toy vehicle of FIG. 1 which has been sectioned to show details.
Figure 5:
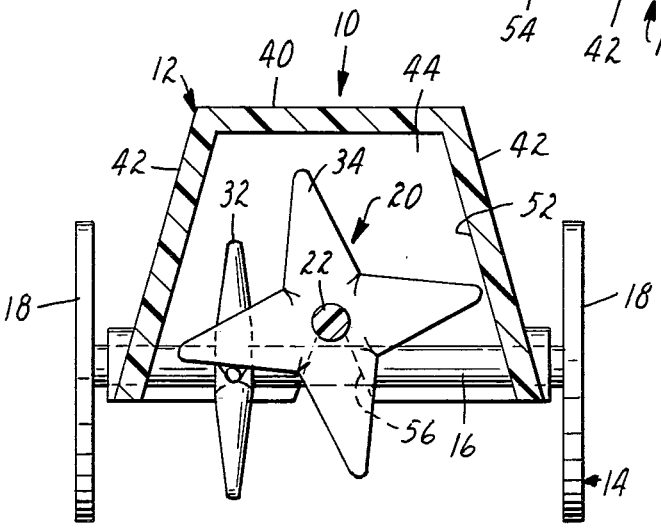
FIG. 5 is an enlarged sectional view taken approximately along line 5—5 of FIG. 3.

Referring now to FIGS. 1 through 5 of the drawing there is shown a first embodiment of a moldable toy vehicle according to the present invention, generally designated by the number 10, which is particularly adapted for the premium industry.

Generally the vehicle 10 comprises a rubber band 11 and three parts molded of a polymeric material, such as polypropylene, consisting of: (1) a unitary body 12 which may be shaped as desired to represent any type of vehicle; (2) a unitary driven member 14 including an axle 16 rotatably mounted on the body 12 and having spaced wheels 18 fixed at its ends, by which wheels 18 the vehicle 10 is partially supported; and (3) a unitary drive member 20 also rotatably mounted on the body 12 and including a drive shaft 22 disposed at a right angle with respect to the axle 16. The drive member 20 is manually rotatable via a crank 24 fixed to the drive shaft 22 to wind the rubber band 11 which is engaged between it and the body 12 so that energy thus stored in the wound rubber band 11 will be transferred to drive the wheels 18 and thereby the vehicle 10 via right-angle intersecting, generally conical-tapered teeth of 4 tooth-driven and driving star gears 32 and 34 included respectively in the driven and drive members 14 and 20.

The driven member 14 is integrally molded and comprises the axle 16 which is cylindrical about an axis, the two circular disk-like wheels 18 which are coaxial with and are fixed at opposite ends of the axle 16, and the driven gear 32 which is coaxially fixed on the axle 16 between the wheels 18. The driven gear 32 is illustrated as having 4 radially projecting conical teeth spaced at generally equal angles around the axis of the axle 16, but alternatively could have 5 or 6 spaced teeth. The driven teeth each have a generally triangular shape in a plane at a right angle to the axis of the driven gear 32 and axle 16 to provide driven edge surfaces disposed at an acute angle with respect to each other, and have generally spherical tips which reduce binding between the gears 32 and 34 when they run together, both when the crank 24 is being wound and when the vehicle 10 is being propelled by the rubber band 11.

The drive member 20 is integrally molded and comprises the drive shaft 22 which is cylindrical about an axis; the crank 24 which is fixed at a first end of the drive shaft 22 and provides means adapted to be manually engaged to rotate the drive shaft 22 about its axis; a hook 38 at a second end of the drive shaft 22 opposite the crank 24, which hook 38 is adapted to receive a length of the rubber band 11; and the drive gear 34 which is fixed coaxially on the drive shaft 22 between the hook 38 and the crank 24 and is illustrated as having 4 radially projecting conical drive teeth spaced at generally equal angles around the axis of the drive shaft 22, but alternatively could have 5 or 6 spaced teeth. The conical teeth of the drive gear 34, like the conical teeth of the driven gear 32, each have a generally triangular shape in a plane at a right angle to the axis of the drive gear 34 and drive shaft 22 to provide driving edge surfaces disposed at an acute angle with respect to each other, and have conical tips that reduce binding between the gears 32 and 34.

The integrally-molded body 12 comprises a plurality of relatively thin intersecting walls including a top wall 40, side walls 42 which join and depend from opposite edges of the top wall 40, a transverse rear wall 44 at one end of the top and side walls 40 and 42, and a front wall 46 at the ends of the top and side walls 40 and 42 opposite the rear wall 44. These walls 40, 42, 44 and 46 define a cavity with a generally U-shaped cross section that opens through a bottom side of the body 12 and is divided into front and rear portions 50 and 52 by a transverse support wall 48. Parts of the top and side walls 40 and 42 converge from the support wall 48 toward the front wall 46 so that the front portion 50 of the cavity decrease in cross-sectional area toward the front wall 46. Disk-like portions 54 of the body 12 are fixed on the outer surfaces of the side walls 42 to simulate front wheels for the vehicle 10, and have arcuate parts depending from the distal edge of the side walls 42 that help support the vehicle 10 and slide along a surface over which the vehicle 10 is propelled. Alternatively, freely-rotatable front wheels could be provided for the body 12 instead of the fixed disk-like portions 54.

The rear and support walls 44 and 48 have surfaces defining opposed transverse, generally U-shaped aperatures 56 and 58 respectively through and centered along their distal edge portions adjacent the bottom side of the body and opening through their distal edges along the bottom side of the body, which surfaces for each aperture 56 or 58 define a semicircular inner surface for the aperture 56 or 58 adapted to journal the drive shaft 22 of the drive member 20 on the side of the axle 16 opposite the bottom side of the body so that releasable retention of the axle 16 on the body 12 by means later to be explained will hold the drive shaft 22 in place in the apertures 56 and 58. The surfaces defining the apertures 56 or 58 provide means for receiving and rotatably supporting the drive member 20 with its hook 38 spaced from a rubber band engaging means or lug 60 projecting from the front wall 40 to support the rubber band 11 therebetween, so that manual rotation of the drive member 20 via its crank 24 will cause the rubber band 11 to twist and elastically stretch to store energy. A collar 62 coaxially fixed on the drive member 20 provides a smooth surface which bears against a boss on the rear wall 44 around the aperture 56 during such rotation to restrict axial movement of the drive member 20 toward the front wall 40 of the body 12 under the influence of the rubber band 11.

The side walls 42 also have surfaces defining opposed generally keyhole-shaped apertures 64 through their distal edge portions and opening through their distal edges, which surfaces for each aperture 64 define a part-circular inner surface for the aperture 64 adapted to journal the axle 16 of the driven member 14, and an outer portion that converges from the distal edge of the side wall 42 toward the part-circular inner portion. The outer portion of each aperture 64 is wide enough at the distal edge of the side wall 42 in which it is formed to guide the axle 16 into the aperture 64 but is too narrow adjacent the inner part-circular portion of the aperture 64 to allow the axle 16 to move into the part-circular portion without resilient deflection of the side wall 42 adjacent the aperture 64, so that once the axle 16 is pressed into the part-circular inner portion of the aperture 64, it will be releasably retained therein. Thus the surfaces defining the apertures 64 provide means for receiving and rotatably supporting the driven member 14 with the axis of its axle 16 transverse of the vehicle 10 and the axis of the drive shaft 22, and teeth of the star gears 32 and 34 positioned for right-angle engagement between their edge surfaces to transfer driving force from the rubber band 11 to the wheels 18.

To assemble and use the toy vehicle 10, a person first positions the drive shaft 22 of the drive member 20 in the apertures 56 and 58 with the hook 38 in the front cavity portion 50, the drive gear 34 in the rear cavity portion 52, and the crank projecting from the rear wall 44. He then presses the axle 16 of the driven member 14 into the apertures 64 with the wheels 18 adjacent the outer surfaces of the side walls 42 until the axle 16 deflects the side walls 42 sufficiently to enter the part-circular inner portions of the apertures 64 so that the driven gear 32 is positioned adjacent and at right angles to the drive gear 34 in the rear cavity portion 52. Opposite ends of the rubber band 11 are then engaged through the hook 38 and around the lug 60 on the front wall 46 of the body 12. The crank 24 is then manually rotated to wind and stretch the rubber band 11, whereupon the toy is placed on a surface and released. The rubber band 11 will then unwind, causing driving tapered edge surfaces of the conical teeth on the drive gear 34 to engage the tapered driven edge surfaces of the conical teeth on the driven gear 32 to drive the wheels 18 and propel the toy vehicle 10 across the surface.

Referring now to FIGS. 6 through 11 of the drawing, there is shown a second embodiment of a moldable toy vehicle according to the present invention generally designated by the number 70, which is adapted for the toy industry. The vehicle 70 is similar to the vehicle 10, but further includes a lock arm 73 that provides a manually-releasable means for stopping operation of the vehicle after a rubber band 71 for powering the vehicle is wound.

Figure 6:
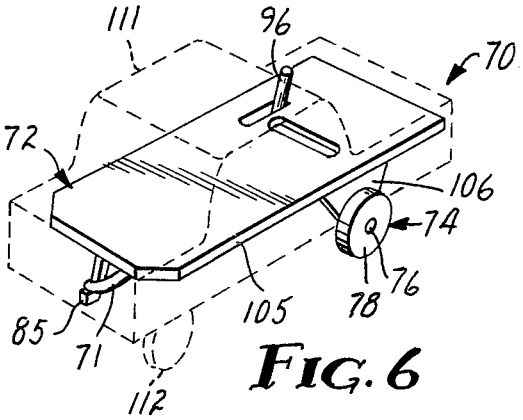
FIG. 6 is a perspective view of a second embodiment of a moldable toy vehicle according to the present invention which illustrates in dotted outline a shape that a body of the vehicle might have.
Figure 8:
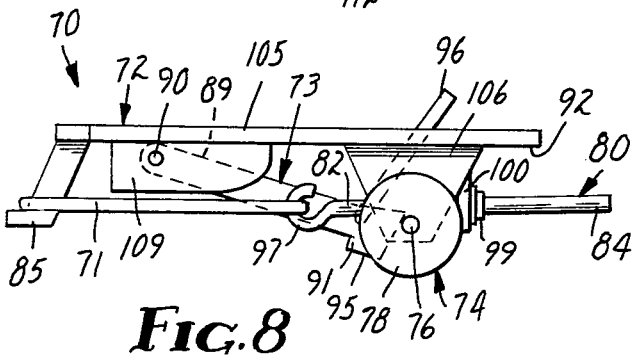
FIG. 8 is a side view of the toy vehicle of FIG. 6.
Figure 7:
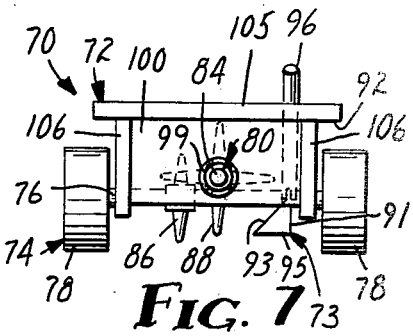
FIG. 7 is a rear end view of the toy vehicle of FIG. 6.

Generally, the vehicle 70 comprises the rubber band 71 and four parts molded of a polymeric material including (1) a unitary body 72 which may be shaped or added to so as to represent a vehicle as indicated in dotted outline in FIG. 6; (2) a driven assembly or member 74 including an axle 76 rotatably mounted on the body 72 and having speed wheels 78 fixed at its ends, by which wheels 78 the vehicle 70 is partially supported; (3) a drive assembly or member 80 also rotatably mounted on the body 72 and including a drive shaft 82 disposed at a right angle with respect to the axle 76, which drive member 80 is manually rotatable via a cylindrical end portion 84 coaxially fixed at one end of the drive shaft 82 to wind the rubber band 71 which is fixed between the drive member 80 and a lug 85 on the body 72 so that energy stored in the rubber band 71 will be transferred to drive the wheels 78 and thereby the vehicle 70 via right-angle intersecting, generally conical-tapered teeth of driven and driving star gears 86 and 88 included respectively in the driven and drive members 74 and 80; and (4) the lock arm 73 which has a first end 89 pivoted on the body 72 at a pin 90 and has an opposite end portion 91 shaped so that when the vehicle 70 is upside down the lock arm 73 is biased by gravity to a lock position (FIGS. 9 and 10) with the end portion 91 of the lock arm 73 resting against a planar surface 92 on the body 72 (which surface 92 is normally above the driving star gear 88). Rotation of the drive member 80 in a clockwise direction (as viewed from the distal end of the end portion 84) will cause the drive teeth of the drive gear 88 to sequentially engage a cam surface 93 on the end portion 91 of the lock arm 73 and raise the lock arm 73 away from the surface 92 and its lock position against the biasing influence of gravity to allow the drive member 80 to be wound. After the drive assembly 80 is wound, one of the drive teeth on the drive gear 88 will engage a stop surface 95 on the lock arm 73 to prevent the drive member 80 (and thereby the driven member 74) from rotating. When the vehicle 72 is subsequently positioned right side up, the end portion 84 can be manually moved via a projecting start rod 96 from its lock position between the teeth of the drive gear 88 and the surface 92 to a release position (FIGS. 7 and 8) where it will be spaced from and will not interfere with the drive teeth of the drive gear 88 so that the drive 80 can drive the driven member 74 and thereby the vehicle 70.

Like the driven member 14, the driven member 74 comprises the cylindrical axle 76, the wheels 78, and the drive gear 86 which has 4 radially projecting drive teeth spaced and shaped like the teeth on the star gears 32 and 34.

The drive member 80 comprises the cylindrical drive shaft 82, the cylindrical manually-engageable end portion 84 which is coaxial with the drive shaft 82, the drive gear 88 which is fixed on the drive shaft 82 and has 4 radially projecting teeth shaped and positioned like the teeth on the star gear 34, the hook 97 at the end of the drive shaft 82 opposite the end portion 84, which hook 97 engages the end of the rubber band 71 opposite a lug 98 on the body 72, and a collar 99 which bears against a rear wall 100 of the body 72 in the manner of the collar 62 of the vehicle 10.

As illustrated in solid outline, the integrally-molded body 72 comprises a plurality of relatively thin intersecting walls including a top wall 105, depending spaced side walls 106 having apertures through which the axle 76 of the driven member 74 is rotatably journaled, the depending rear wall having an open-side aperture in which the drive shaft 82 of the drive member 80 is rotatably mounted, and parallel spaced depending guide walls 109 between which extends the pin 90 on which the lock arm 73 is pivoted, and which guide the opposite side surfaces of the lock arm 73. As illustrated in dotted outline in FIG. 1, the body 72 could have additional walls 111 of any desired shape to represent a desired type of vehicle, which additional walls 111 could include arcuate parts 112 that help support the vehicle 70 and slide along a surface over which the vehicle 70 is propelled (which arcuate parts 112 could alternatively be replaced by wheels mounted for free rotation on the body 72).

The surface defining the aperture in the rear wall 100 provides means for rotatably supporting the drive member with its hook spaced from a rubber band engaging means provided by the lug 98 to support the rubber band 71 therebetween, so that manual rotation of the drive member 80 via its end portion 84 will cause the rubber band 71 to twist and elastically stretch to store energy; and the surfaces defining the apertures in the side walls 106 provide means for rotatably supporting the drive member 74 with the axis of its axle 76 transverse of the vehicle 70 and the axis of the drive shaft 82, and teeth of the gears 84 and 86 positioned for right-angle engagement between their edge surfaces to transfer driving force from the rubber band 71 to the wheels 78.

Figure 9:
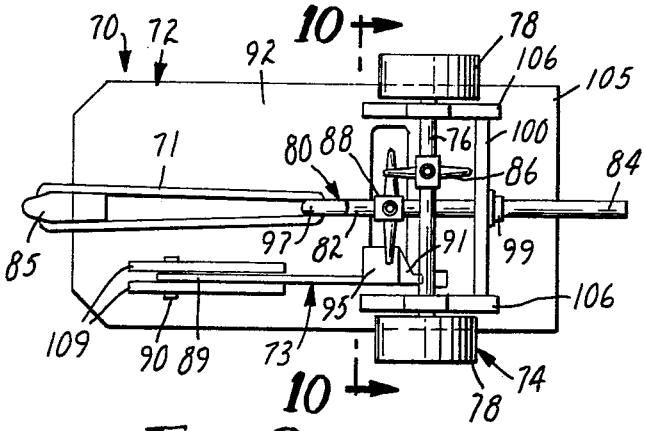
FIG. 9 is a bottom view of the toy vehicle of FIG. 6 with the vehicle inverted so that a lock arm in the vehicle has moved to its lock position.
Figure 10:
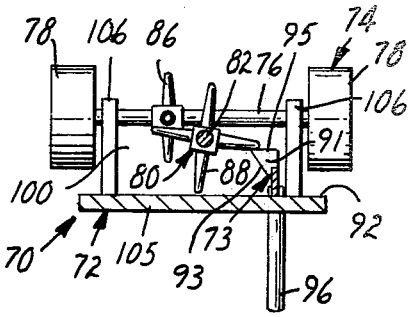
FIG. 10 is a sectional view taken approximately along line 10—10 of FIG. 9.
Figure 11:
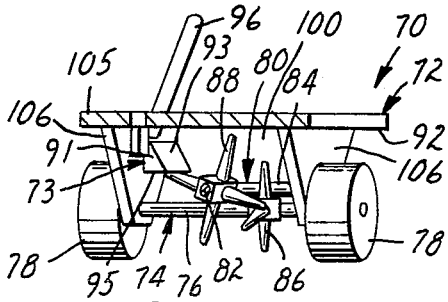
FIG. 11 is a perspective sectional view similar to FIG. 10 except that the vehicle is in an upright position.

To operate the vehicle 70, a user first turns it bottom side up (FIG. 10) so that the end portion 91 of the lock arm 73 is biased by gravity to its lock position against the surface 92 of the body 72. The user then manually rotates the end portion 84 clockwise as viewed from its distal end to wind the rubber band 71, whereupon the tips of the drive teeth on the drive gear 88 will engage the cam surface 93 on the end portion and lift the lock arm 73 away from its lock position as the drive teeth pass the end portion 91. Subsequently when the rubber band 71 is wound and the end portion 84 is released, one of the drive teeth on the drive gear 88 will engage the stop surface 95 on the end portion 91 and press the end portion 91 against the surface 92 to prevent the drive member 74 from rotating under the influence of the rubber band 71 (FIGS. 9 and 10). That drive tooth will hold the lock arm 73 in its lock position so that the vehicle 70 can be turned right side up (FIG. 11), whereupon when movement of the vehicle 70 is desired, the lock arm 73 may be manually pressed to its release position (FIGS. 7 and 8) via the start rod 96, whereupon the end portion will not interfere with the drive gear 88 and the rubber band can propel the vehicle across a surface.

The vehicle according to the present invention has now been described with reference to two embodiments thereof. It will be appreciated by those skilled in the art that the vehicle may be changed from the embodiments illustrated without departing from the spirit of the invention. For example, the drive and driven members for some embodiments may be made other than as an integral molding. The number of teeth on the star gears may be varied, and may have shapes other than that illustrated such as cylindrical, or triangular with edges that provide the edge surfaces disposed in the preferred angular relationships indicated. Thus the scope of the present invention should not be limited by the structure of the embodiments illustrated, but only by the structures described by the dependent claims and their equivalents.

I claim:

1. A toy vehicle consisting only of parts molded in finished form of a polymeric material in combination with a rubber band, said parts comprising:

a unitary integrally molded driven member comprising an axle having an axis, two wheels coaxial with and at opposite ends of said axle, and a star gear coaxially fixed on said axle between said wheels and having 4 to 6 radially projecting teeth disposed at generally equal angles about said axle;

a unitary integrally molded drive member comprising a drive shaft having an axis and first and second ends, winding means at said first end adapted to be manually engaged to rotate said drive shaft about its axis, a hook at an end of said drive shaft opposite said winding means receiving a length of said rubber band, and a star gear coaxially fixed on said drive shaft between said winding means and hook and having 4 to 6 radially projecting teeth disposed at generally equal angles about said drive shaft; and a unitary integrally molded body including interconnected walls defining a cavity opening through a bottom side of said body, band engagement means adjacent one end of said body engaging a portion of said rubber band, means at the end of said body opposite said one end receiving and rotatably supporting the drive shaft of said drive member adjacent said winding means with said hook within said cavity and sapced from said band engagement means to support said rubber band therebetween, and means on said walls along the bottom side of said body receiving and rotatably retaining the axle of said driven member with the axis of said axle transverse to the axis of said drive shaft, with said drive shaft on the side of said axle opposite said bottom side of said body to retain said drive shaft in place and with the teeth of said star gears positioned in right-angle engagement to transfer driving force from said rubber band to said wheels.

2. A toy vehicle according to claim 1 wherein each star gear has 4 teeth and the teeth of each star gear have tapered edges disposed at an angle of 10 to 30 degrees with respect to each other in a plane normal to the axis of the star gear.

3. A toy vehicle according to claim 1 or claim 2 wherein the teeth on said star gears are conical.

4. A toy vehilce according to claim 1 wherein said winding means at said first end adapted to be manually engaged comprises a crank.

5. A toy vehicle according to claim 1 wherein said body includes a body surface above said drive shaft when said vehicle is in an upright position; and said vehicle includes a lock arm having a first end pivotably mounted on said body to afford movement of a second end of said lock arm between a lock position against said body surface and adjacent said drive teeth to which said lock arm is biased by gravity when said vehicle is inverted, and a release position spaced from said drive teeth to which said lock arm is biased by gravity when said vehicle is upright, said second end having a cam surface adapted to be engaged by said drive teeth to move said lock arm toward its release position and afford movement of said drive teeth when said drive member is wound, and having a stop surface adapted to be engaged by one of said drive teeth to stop rotation of said drive member under the influence of the wound rubber band by pressing said second end of said lock arm against said body surface when said lock arm is in its lock position.

* * * * *